US007246726B2

(12) United States Patent
Ikushima

(10) Patent No.: US 7,246,726 B2
(45) Date of Patent: Jul. 24, 2007

(54) LIQUID MATERIAL DELIVERING METHOD AND DEVICE THEREFOR

(75) Inventor: Kazumasa Ikushima, Mitaka (JP)

(73) Assignee: Musashi Engineering, Inc., Tokyo (JP)

( * ) Notice: Subject to any disclaimer, the term of this patent is extended or adjusted under 35 U.S.C. 154(b) by 7 days.

(21) Appl. No.: 10/493,413

(22) PCT Filed: Oct. 22, 2002

(86) PCT No.: PCT/JP02/10924

§ 371 (c)(1),
(2), (4) Date: Nov. 5, 2004

(87) PCT Pub. No.: WO03/035276

PCT Pub. Date: May 1, 2003

(65) Prior Publication Data

US 2005/0061391 A1 Mar. 24, 2005

(30) Foreign Application Priority Data

Oct. 25, 2001 (JP) ..... 2001-328313

(51) Int. Cl.
*B05C 5/00* (2006.01)

(52) U.S. Cl. ..... 222/422; 222/109

(58) Field of Classification Search ..... 222/1; 141/20

See application file for complete search history.

(56) References Cited

U.S. PATENT DOCUMENTS 3,604,477 A * 9/1971 Grothoff ..... 141/20
4,988,015 A * 1/1991 Price ..... 222/1
4,995,431 A * 2/1991 Wakabayashi et al. ..... 141/116
5,195,656 A * 3/1993 Briehl et al. ..... 222/1
5,205,439 A * 4/1993 Sturm ..... 222/1
5,230,373 A * 7/1993 Engler ..... 141/147
6,056,155 A * 5/2000 Byerly et al. ..... 222/1
6,138,720 A * 10/2000 Zeigler ..... 141/20
2005/0067438 A1 3/2005 Ikushima

FOREIGN PATENT DOCUMENTS

JP S52-121803 U1 3/1976
JP 185569/1986 11/1986
JP S63-126564 U1 8/1988
JP H4-1677 U1 1/1992
JP 57461/1994 8/1994
JP 2001-319074 A 10/2001

* cited by examiner

*Primary Examiner*—J. Casimer Jacyna
(74) *Attorney, Agent, or Firm*—Westerman, Hattori, Daniels & Adrian, LLP.

(57) ABSTRACT

A method and a device for accurate delivery, dripping and ejection in the form of flying droplets are provided. A liquid material is pressurized by a plunger sliding in a liquid feed passageway. A sliding surface of the plunger section sliding while closely contacting the inner wall surface of the liquid feed passageway divides the space into a nozzle-side liquid material part and a storage container-side liquid material part. The liquid material in the nozzle-side liquid material part is delivered by the plunger section advancing in the liquid feed passageway. A liquid material delivering device has a liquid material storage section, a nozzle section for delivering the liquid material, a liquid feed passageway for establishing communication between the storage section and the nozzle section, a plunger section, and plunger moving means for advancing and retracting the plunger section.

20 Claims, 4 Drawing Sheets

LIQUID MATERIAL DELIVERING METHOD AND DEVICE THEREFOR

TECHNICAL FIELD

The present invention relates to the field in which a liquid material is pressurized by a plunger sliding while closely contacting an inner wall surface of a liquid feed passageway to deliver the liquid material through a nozzle. More particularly, the present invention relates to a liquid material delivering method and device, which can prevent undesired drying and sticking of the liquid material on the inner surface of the liquid feed passageway and undesired leakage of the liquid material from the plunger, can reduce the volume of a space in which the plunger is disposed to pressurize the liquid material, thereby ensuring accurate delivery, and can eliminate loss of the liquid material during the operation of purging air bubbles trapped in the liquid material, thereby realizing efficient of the liquid material.

Herein, the term "delivery" means that the liquid material is delivered, dripped, or ejection in the form of flying droplets.

BACKGROUND ART

A known technique for ejecting a liquid material in the form of flying droplets employs a retracting and advancing plunger. The plunger is quickly accelerated to advance and then abruptly stopped by abutting it against a valve seat. Upon the abrupt stop, an inertial force is applied to the liquid material present in front of the plunger, thus causing the liquid material to eject in the form of flying droplets under the action of the inertial force. With such a known technique, however, because the inertial force required for ejecting a liquid material in the form of flying droplets is obtained by abutting a moving solid plunger against a stationary solid valve seat and momentarily stopping the movement of the plunger, there arise problems that the plunger and the valve seat are seriously damaged by the abutting. Another problem is that a damaged member is mixed into the liquid material to melt therein.

With the view of solving those problems, the applicant previously proposed a technique wherein, after bringing a distal end surface of a plunger for delivering the liquid material into close contact with the liquid material, the plunger is accelerated to advance at high speed, and subsequently a plunger driving means is abruptly stopped to suddenly stop the plunger advancing at high speed without abutting it against a valve seat, so that an inertial force is applied to the liquid material present in front of the plunger and the liquid material is ejected in the form of flying droplets by the applied inertial force (Japanese Patent Application No. 2001-319074).

DISCLOSURE OF THE INVENTION

The invention of the above prior application has succeeded in achieving the intended object, but the following problems were found in the process of carrying out the prior invention in practical use.

With repeated operations of advancing and retracting the plunger, the liquid material having seeped little by little through a seal portion of the plunger is dried and stuck to an inner wall surface of a metering section. As a result, smooth sliding of the plunger is impeded and the liquid material cannot be delivered in a fixed amount. In addition, the liquid material may leak through the seal portion and eventually fail to come out in some cases.

Also, in the previously proposed device, because the liquid material is supplied from a storage container for storing the liquid material to flow into the metering section via a route in which a liquid material feed valve is disposed, the liquid material present between the metering section and the liquid material feed valve is also pressurized with advance of the plunger. In a system requiring a sharp pressure rise, therefore, a factor of preventing the sharp pressure rise is resulted because a space uselessly occupied by the liquid material is increased.

Further, in the previously proposed device, because air bubbles are purged out by discharging trapped gas to open air through a purge hole formed in a plunger rod, the liquid may also be discharged in a mixed state together with a group of air bubbles. Conventionally, the discharged liquid material has had to be removed using a piece of rag or the like.

In the past, therefore, it has been unavoidable that the device is contaminated with the liquid material adhering to the plunger member and the liquid is wasted even though in a small amount. In the case of the liquid being expensive, particularly, the waste of the liquid must be avoided even in a small amount. Taking into account influences of air bubbles upon the liquid delivery in a fixed amount, i.e., the fact that the liquid including air bubbles trapped therein cannot be delivered in a fixed amount, however, the trapped air bubbles have had to be purged out in spite of wasting the expensive liquid. Further, when ejecting the liquid material in the form of flying droplets, the presence of air bubbles may disable the satisfactory ejection in some cases.

With the view of solving the problems set forth above, an object of the present invention is to provide a method and a device for accurate delivery, dripping and ejection in the form of flying droplets. Another object of the present invention is to provide a liquid delivering method and device, which can effectively purge out air bubbled trapped in a liquid material, and can utilize the liquid material, which is discharged in a mixed state together with a group of air bubbles during the air bubble purging operation, again for delivery, dripping and ejection in the form of flying droplets without wasting the liquid material.

The present invention resides in a liquid material delivering method wherein a liquid material is pressurized by a plunger sliding while closely contacting an inner wall surface of a liquid feed passageway establishing communication between a nozzle and a storage section, thereby delivering the liquid material through the nozzle.

The plunger is disposed in a space filled with the liquid material. In this case, the present invention resides in a liquid material delivering method wherein a liquid material is pressurized by a plunger sliding while closely contacting an inner wall surface of a liquid feed passageway establishing communication between a nozzle and a storage section, the plunger being disposed in a space filled with the liquid material, thereby delivering the liquid material through the nozzle.

A sliding surface of the plunger section sliding while closely contacting the inner wall surface of the liquid feed passageway divides the space into a nozzle-side liquid material part and a storage container-side liquid material part, and of divided two parts of the liquid material, the liquid material in the nozzle-side liquid material part is delivered by the plunger section advancing in the liquid feed passageway. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, and of divided two parts of the liquid material, the liquid material in the nozzle-side liquid material part is delivered by the plunger section advancing in the liquid feed passageway.

The plunger section includes a valve mechanism for establishing or cutting off communication between the nozzle-side liquid material part and the storage container-side liquid material part, and the plunger section is advanced in the liquid feed passageway with the valve mechanism held in a closed state, thereby delivering the liquid material. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, the plunger section including a valve mechanism for establishing or cutting off communication between the nozzle-side liquid material part and the storage container-side liquid material part, and of divided two parts of the liquid material, the liquid material in the nozzle-side liquid material part is delivered by the plunger section advancing in the liquid feed passageway with the valve mechanism held in a closed state.

A tip of the plunger section is constituted as a plunger head disposed in a flow passage, and the plunger head is advanced in the liquid material, thereby delivering the liquid material. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, a tip of the plunger section being constituted as a plunger head disposed in a flow passage, and of divided two parts of the liquid material, the liquid material in the nozzle-side liquid material part is delivered by advancing the plunger head of the plunger section in the liquid material.

The delivering method includes a first step of forming the nozzle-side liquid material part as a closed area, preferably forming the closed area by using a delivery valve disposed at a distal end of the liquid feed passageway or midway the liquid feed passageway, and more preferably forming the closed area by using closing means for closing a delivery port at a nozzle tip, a second step of retracting the plunger section to feed the liquid into the liquid feed passageway from the liquid material storage section, and a third step of advancing the plunger section to deliver the liquid material. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, and of divided two parts of the liquid material, the liquid material in the nozzle-side liquid material part is delivered by the plunger section advancing in the liquid feed passageway, the delivering method including a first step of forming the nozzle-side liquid material part as a closed area, preferably forming the closed area by using a delivery valve disposed at a distal end of the liquid feed passageway or midway the liquid feed passageway, and more preferably forming the closed area by using closing means for closing a delivery port at a nozzle tip, a second step of retracting the plunger section to feed the liquid into the liquid feed passageway from the liquid material storage section, and a third step of advancing the plunger section to deliver the liquid material.

The first step includes a fifth step of establishing communication between the nozzle-side liquid material part and the storage section-side liquid material part. The fifth step is preferably performed with the valve mechanism provided in the plunger section. The delivering method includes, between the second step and the third step, a fourth step of purging out air bubbles trapped in the liquid material in the liquid feed passageway as the occasion requires. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, and of divided two parts of the liquid material, the liquid material in the nozzle-side liquid material part is delivered by the plunger section advancing in the liquid feed passageway, the delivering method including a first step of forming the nozzle-side liquid material part as a closed area, preferably forming the closed area by using a delivery valve disposed at a distal end of the liquid feed passageway or midway the liquid feed passageway, and more preferably forming the closed area by using closing means for closing a delivery port at a nozzle tip, the first step including a fifth step of establishing communication between the nozzle-side liquid material part and the storage section-side liquid material part, the fifth step being preferably performed with the valve mechanism provided in the plunger section, a second step of retracting the plunger section to feed the liquid into the liquid feed passageway from the liquid material storage section, and a third step of advancing the plunger section to deliver the liquid material, the delivering method further including, between the second step and the third step, a fourth step of purging out air bubbles trapped in the liquid material in the liquid feed passageway as the occasion requires.

The fourth step comprises a sixth step of forming the nozzle-side liquid material part as a closed area and establishing communication between the nozzle-side liquid material part and the storage section-side liquid material part, and a seventh step of advancing the plunger section. In this case, the present invention resides in a liquid material delivering method wherein a sliding surface of the plunger section, which slides while closely contacting an inner wall surface of a liquid feed passageway establishing communication between a nozzle and a storage section and which is preferably disposed in a space filled with the liquid material, divides the space into a nozzle-side liquid material part and a storage container-side liquid material part, and of divided two parts of the liquid material, the liquid material in the nozzle-side liquid material part is delivered by the plunger section advancing in the liquid feed passageway, the delivering method including a first step of establishing the nozzle-side liquid material part as a closed area, preferably forming the closed area by using a delivery valve disposed at a distal end of the liquid feed passageway or midway the liquid feed passageway, and more preferably forming the closed area by using closing means for closing a delivery port at a nozzle tip, the first step including a fifth step of establishing communication between the nozzle-side liquid material part and the storage section-side liquid material part, the fifth step being preferably performed with the valve mechanism provided in the plunger section, a second step of retracting the plunger section to feed the liquid into the liquid feed passageway from the liquid material storage section, and a third step of advancing the plunger section to deliver the liquid material, the delivering method further including, between the second step and the third step, a fourth step of purging out air bubbles trapped in the liquid material in the liquid feed passageway as the occasion requires, the fourth step comprising a sixth step of forming the nozzle-side liquid material part as a closed area and establishing communication between the nozzle-side liquid material part and the storage section-side liquid material part, and a seventh step of advancing the plunger section.

Also, the present invention resides in a liquid material delivering device comprising a liquid material storage section for storing a liquid material, a nozzle section for delivering the liquid material, a liquid feed passageway for establishing communication between the storage section and the nozzle section, a plunger section having a seal portion sliding while closely contacting an inner surface of the liquid feed passageway, and plunger moving means for advancing and retracting the plunger section, the delivering device further comprising another liquid feed passageway 2 for establishing communication between a portion of the liquid feed passageway near a nozzle-side distal end thereof and a portion of the liquid feed passageway near the liquid material storage section or the liquid material storage section itself, and a liquid feed valve disposed at a distal end of the another liquid feed passageway 2 or midway the anther liquid feed passageway 2.

Further, the present invention resides in a liquid material delivering device comprising a liquid material storage section for storing a liquid material, a nozzle section for delivering the liquid material, a liquid feed passageway for establishing communication between the storage section and the nozzle section, a plunger section having a seal portion sliding while closely contacting an inner surface of the liquid feed passageway, plunger moving means for advancing and retracting the plunger section, a delivery valve disposed at a nozzle-side distal end of the liquid feed passageway or midway the liquid feed passageway, and another liquid feed passageway 2 for establishing communication between the delivery valve and a portion of the liquid feed passageway near the liquid material storage section or the liquid material storage section itself, the delivery valve taking a first position at which the liquid feed passageway is communicated with the nozzle, and a second position at which the liquid feed passageway is communicated with the another liquid feed passageway 2.

Still further, the present invention resides in a liquid material delivering device comprising a liquid material storage section for storing a liquid material, a nozzle section for delivering the liquid material, a liquid feed passageway for establishing communication between the storage section and the nozzle section, and a plunger section having a seal portion sliding while closely contacting an inner surface of the liquid feed passageway, the plunger section including a valve mechanism for establishing or cutting off communication between the nozzle section and the storage section. Preferably, the delivering device further comprises a delivery valve disposed in a portion of the liquid feed passageway neat a nozzle-side distal end thereof or midway the liquid feed passageway. As appropriate, the inner diameter of the liquid feed passageway and the inner diameter of the delivery valve are substantially equal to each other.

In the liquid material delivering device of the present invention, more specifically, the plunger section comprises a plunger rod having a tubular portion formed with a first hole 1 opened to an outer wall surface of the plunger rod, a plunger head fitted to a tip of the plunger rod, having a second hole 2 communicating with the tubular portion of the plunger rod, and including a seal portion projecting on an outer wall surface of the plunger head to be closely contacted with the inner wall surface of the liquid feed passageway, a valve rod inserted in the tubular portion of the plunger rod, valve rod driving means for moving the valve head to be closely contacted with or apart away from the plunger head.

In that case, the liquid material delivering device delivers the liquid material through a first step of closing the delivery valve and opening the valve rod inserted in the tubular portion of the plunger rod with respect to the plunger head, a second step of retracting the plunger section to feed the liquid material into the liquid feed passageway from the liquid material storage section, a third step of retracting the plunger section to move the liquid material from the storage section-side liquid material part into the nozzle-side liquid material part, a fourth step of opening the delivery valve and closing the valve rod, and a fifth step of advancing and the plunger section.

BRIEF DESCRIPTION OF THE DRAWINGS

FIG. 1 is a conceptual view showing one embodiment of the present invention in which; FIG. 1(*a*) is a front view and FIG. 1(*b*) is a side view.

FIG. 2 is a conceptual view showing another embodiment of the present invention in which; FIG. 2(*a*) is a front view and FIG. 2(*b*) is a side view.

FIG. 3 is a conceptual view showing still another embodiment of the present invention in which; FIG. 3(*a*) is a front view and FIG. 3(*b*) is a side view.

BEST MODE FOR CARRYING OUT THE INVENTION

Figure 1:
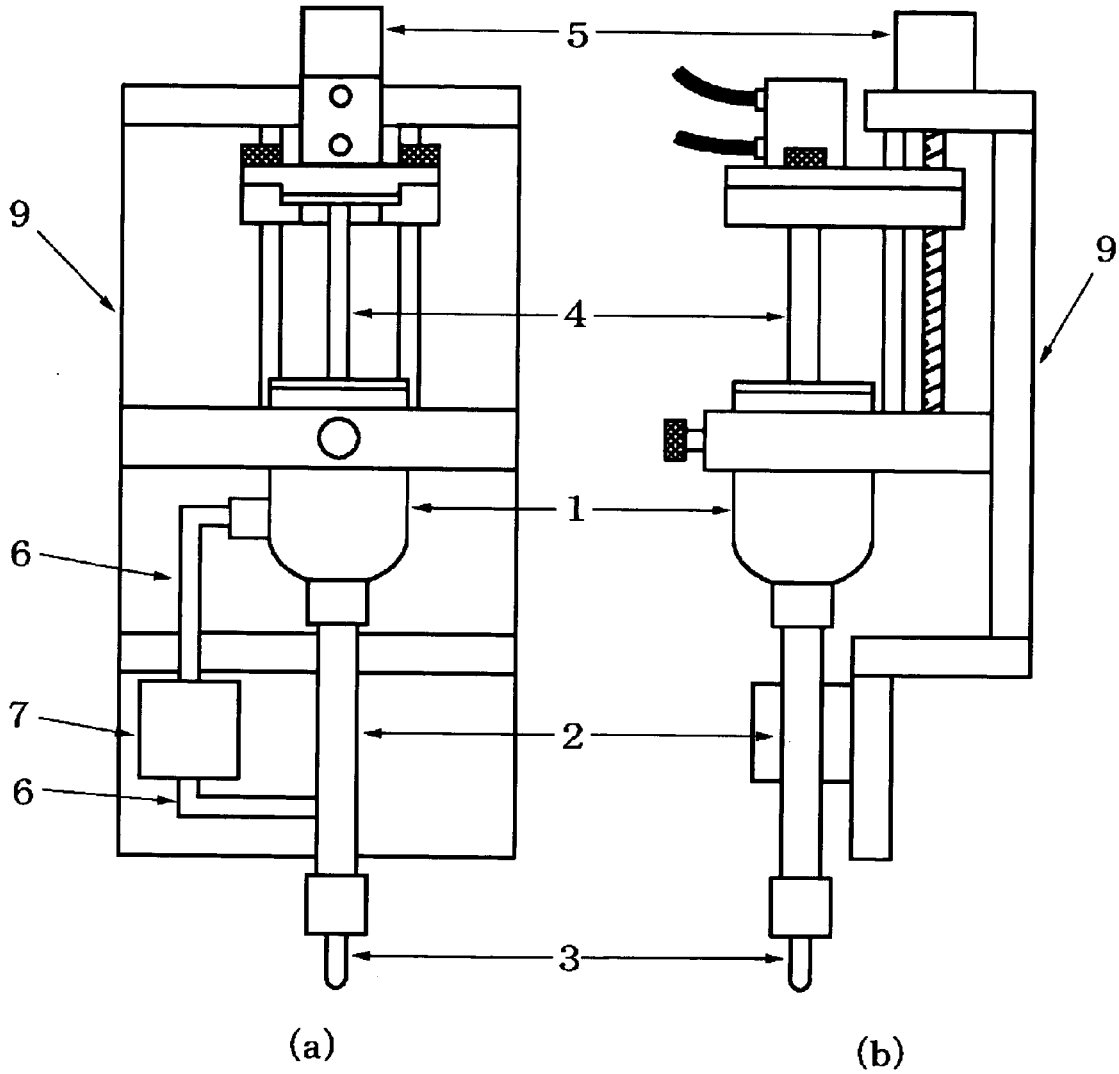

A sliding surface of a plunger section sliding while closely contacting an inner wall surface of a liquid feed passageway for establishing communication between a nozzle and a liquid material storage section divides a liquid material space into a nozzle-side liquid material part and a storage container-side liquid material part, and of divided two parts of the liquid material, the liquid material in the nozzle-side liquid material part is delivered by the plunger section advancing in the liquid feed passageway. Here, the amount of the delivered liquid material is decided depending on the amount by which the plunger section is advanced. Also, since the sliding surface of the plunger section is disposed in a flow passage defined by the liquid feed passageway, a tip of the plunger section is always kept in contact with the liquid material.

Preferably, the plunger section includes a valve mechanism for establishing or cutting off communication between the nozzle-side liquid material part and the storage container-side liquid material part, and the plunger section is advanced in the liquid feed passageway with the valve mechanism held in a closed state, thereby delivering the liquid material.

Because of the plunger section including the valve mechanism, it is no longer required to branch the flow passage for feeding the liquid material.

During the delivery, in particular, since the plunger section is advanced with the valve mechanism held in the closed state, the liquid material can be smoothly pressurized for the delivery.

Also, preferably, a tip of the plunger section is constituted as a plunger head disposed in the flow passage, and the plunger head is advanced in the liquid material.

The plunger head constituted by the tip of the plunger section directly pressurizes the liquid material to be delivered. Since the plunger is disposed in the flow passage, the plunger head is always positioned in the liquid material and an outer peripheral of the plunger head is held in contact with the liquid material.

In the liquid material delivering method wherein the plunger section is advanced while closely contacting the inner wall surface of the liquid feed passageway to deliver the liquid material, the delivering process includes a first step of forming the nozzle-side liquid material part as a closed area by using closing means, a second step of retracting the plunger section to feed the liquid into the liquid feed passageway from the liquid material storage section, and a third step of advancing the plunger section to deliver the liquid material.

Preferably, the first step includes a fifth step of establishing communication between the nozzle-side liquid material part and the storage section-side liquid material part.

More preferably, the delivering method includes, between the second step and the third step, a fourth step of purging out air bubbles trapped in the liquid material in the liquid feed passageway. Even more preferably, the fourth step comprises a sixth step of forming the nozzle-side liquid material part as a closed area by using the closing means and establishing communication between the nozzle-side liquid material part and the storage section-side liquid material part, and a seventh step of advancing the plunger section.

The closing means is preferably a delivery valve disposed at a distal end of the liquid feed passageway or midway the liquid feed passageway. The nozzle-side liquid material part can be formed as the closed area by setting the delivery valve to its closed position. As an alternative, the closing means closes a delivery port at a nozzle tip. In practice, a cap or a similar means may be fitted to the delivery port for closing it.

Preferably, the fifth step is performed with the valve mechanism provided in the plunger section.

When using the valve mechanism provided in the plunger section, the liquid material is preferably delivered through a 21st step of closing the delivery valve and opening the valve rod (i.e., 21st step of forming the nozzle-side liquid material part as the closed area and opening the plunger valve mechanism), a 22nd step of retracting the plunger section to feed the liquid material into the liquid feed passageway from the liquid material storage section, a 23rd step of retracting the plunger section to move the liquid material from the storage section-side liquid material part into the nozzle-side liquid material part, a 24th step of opening the delivery valve and closing the valve rod, and a 25th step of advancing and the plunger section.

A liquid material delivering device comprises a liquid material storage section for storing a liquid material, a nozzle section for delivering the liquid material, a liquid feed passageway for establishing communication between the storage section and the nozzle section, a plunger section having a seal portion sliding while closely contacting an inner surface of the liquid feed passageway, and plunger moving means for advancing and retracting the plunger section, the delivering device further comprising another liquid feed passageway 2 for establishing communication between a portion of the liquid feed passageway near a nozzle-side distal end thereof and a portion of the liquid feed passageway near the liquid material storage section or the liquid material storage section itself, and a liquid feed valve disposed at a distal end of the another liquid feed passageway 2 or midway the anther liquid feed passageway 2.

Unlike the prior art in which only the pressurizing surface of the plunger contacts the liquid material, the plunger section is disposed in the flow passage of the liquid material to be always immersed in the liquid material, and the inner wall surface of the liquid feed passageway, along which the plunger slides, is always kept in contact with the liquid material. Therefore, the liquid material is avoided from drying and sticking to the plunger surface and the inner wall surface of the liquid feed passageway. Also, from the viewpoint of the device structure, there is no possibility in principle that the liquid material may undesirably leak from the plunger and may stick to the components and positions, which should be essentially kept from sticking of the liquid material.

The liquid feed passageway is provided between the liquid material storage section for storing the liquid material and the nozzle for delivering the liquid material, and the liquid material is pressurized by the plunger sliding while closely contacting the inner wall surface of the liquid feed passageway to deliver the liquid material through the nozzle.

To feed the liquid material from the liquid material storage section into the liquid feed passageway, the nozzle-side liquid material part in which one of two parts of the liquid material, divided by the plunger, nearer to the nozzle is positioned must be brought into a closed state.

The delivery valve is required to close the nozzle-side liquid material part. As an alternative, the nozzle-side liquid material part may be closed by fitting a cap to a nozzle tip instead of using the delivery valve.

The delivering device of the present invention comprises a liquid material storage section for storing a liquid material, a nozzle section for delivering the liquid material, a liquid feed passageway for establishing communication between the storage section and the nozzle section, a plunger section having a seal portion sliding while closely contacting an inner surface of the liquid feed passageway, and plunger moving means for advancing and retracting the plunger section, the delivering device further comprising another liquid feed passageway 2 for establishing communication between a portion of the liquid feed passageway near a nozzle-side distal end thereof and a portion of the liquid feed passageway near the liquid material storage section or the liquid material storage section itself, and a liquid feed valve disposed at a distal end of the another liquid feed passageway 2 or midway the another liquid feed passageway 2. Two parts of the liquid material divided by the sliding surface of the plunger section sliding while closely contacting the inner surface of the liquid feed passageway are communicated with each other through the delivery valve so that the liquid material can be fed to the liquid feed passageway 1.

Operation

The liquid material delivering device of the present invention comprises a liquid material storage section for storing a liquid material, a nozzle section for delivering the liquid material, a liquid feed passageway for establishing communication between the storage section and the nozzle section, a plunger section having a seal portion sliding while closely contacting an inner surface of the liquid feed passageway, and plunger moving means for advancing and retracting the plunger section, the delivering device further comprising another liquid feed passageway 2 for establishing communication between a portion of the liquid feed passageway near a nozzle-side distal end thereof and a portion of the liquid feed passageway near the liquid material storage section or the liquid material storage section itself, and a liquid feed valve disposed at a distal end of the another liquid feed passageway 2 or midway the another liquid feed passageway 2.

Unlike the prior art in which only the pressurizing surface of the plunger contacts the liquid material, the plunger section is disposed in the flow passage of the liquid material to be always immersed in the liquid material, and the inner wall surface of the liquid feed passageway, along which the plunger slides, is always kept in contact with the liquid material. Therefore, the liquid material is avoided from drying and sticking to the plunger surface and the inner wall surface of the liquid feed passageway. Also, from the viewpoint of the device structure, there is no possibility in principle that the liquid material may undesirably leak from the plunger and may stick to the components and positions, which should be essentially kept from sticking of the liquid material.

According to the present invention, the liquid feed passageway is provided between the liquid material storage section for storing the liquid material and the nozzle for delivering the liquid material, and the liquid material is pressurized by the plunger sliding while closely contacting the inner wall surface of the liquid feed passageway to deliver the liquid material through the nozzle.

To feed the liquid material from the liquid material storage section into the liquid feed passageway, the nozzle-side liquid material part in which one of two parts of the liquid material, divided by the plunger, nearer to the nozzle is positioned must be closed.

The delivery valve is required to close the nozzle-side liquid material part. As an alternative, the nozzle-side liquid material part may be closed by fitting a cap to a nozzle tip instead of using the delivery valve.

By quickly accelerating the plunger to advance and then abruptly stopping the plunger so as to apply a great inertial force to the liquid material, the liquid material in the nozzle-side liquid material part is ejected to fly in the form of small droplets while the amount of the ejected liquid droplets is controlled depending on, e.g., the moving speed of the plunger and the distance of movement of the plunger.

Also, by operating the plunger to be quickly accelerated to advance and then abruptly stopped, the liquid material filled in the nozzle-side liquid material part is given with an inertial force, whereby the liquid droplets are delivered through the nozzle tip. The delivering operation is carried out by delivering the liquid material, which has been divided and moved into the nozzle-side liquid material part each time when the plunger is advanced, through the steps of quickly accelerating the plunger to advance and then abruptly stopping it, which are repeated plural times.

Alternatively, the liquid material, which has been divided and moved into the nozzle-side liquid material part each time when the plunger is advanced, can also be ejected in the form of flying droplets at a time with proper adjustment of the moving speed of the plunger and the distance of movement of the plunger.

In order to eject the liquid material in the form of flying droplets, therefore, an acceleration, i.e., a speed difference, applied to the plunger is important. The plunger must be moved at high speed by initial acceleration and then abruptly stopped. The plunger is controlled by the plunger driving means in such a manner. Increasing the plunger speed up to a level necessary for ejecting the liquid material in the form of flying droplets requires a distance for acceleration through which the plunger is accelerated to a certain level.

Note that the amount of the ejected liquid droplets is dependent on the distance of movement of the plunger, but if the distance of movement of the plunger is set to be short depending on the amount of the ejected liquid droplets, the plunger speed required for ejecting the liquid material in the form of flying droplets cannot be obtained. Based on the relationship between the amount of the ejected liquid droplets and the moving speed of the plunger suitable for ejecting the liquid material in the form of flying droplets, therefore, specifications of the liquid feed passageway and the plunger are decided so that the distance of movement of the plunger sufficient to provide the required plunger speed is obtained.

Further, to reduce the amount of the ejected liquid droplets, it is needed to shorten the stroke (distance of movement) of the plunger. On the other hand, the stroke (distance of movement) of the plunger must be increased from the viewpoint of obtaining the plunger speed sufficient to eject the liquid material in the form of flying droplets. In order to satisfy those contradictory demands at the same time, the liquid feed passageway is designed to be relatively thin so that the distance of movement of the plunger is ensured which provides the plunger speed sufficient to eject the liquid material in the form of flying droplets. Also, with the thinning of the liquid feed passageway, the volume produced by the movement of the plunger, i.e., the amount of the ejected liquid droplets, can be reduced even when the plunger is moved over a relatively large stroke.

Several embodiments of the present invention will be described below with reference to the drawings, but the present invention is limited in no way by the following embodiments.

In the following description of Embodiments 1 to 3, the same components are denoted by the same reference numerals.

EMBODIMENT 1

One embodiment of the present invention comprises, as shown in FIG. 1, a liquid material storage section 1 for storing a liquid material, a nozzle section 3 for delivering the liquid material, a liquid feed passageway 2 for establishing communication between the storage section and the nozzle section 3, a plunger section 4 having a seal portion sliding while closely contacting an inner surface of the liquid feed passageway 2, a plunger moving means 5 for advancing and retracting the plunger section 4, a liquid feed passageway 6 for establishing communication between the liquid material storage section 1 and a portion of the liquid feed passageway 2 near a nozzle-side distal end thereof, a liquid feed valve 7 disposed midway the liquid feed passageway 6, and a frame 9 for supporting the above-mentioned components.

The frame 9 comprises a guide rod for guiding a plunger support in the vertical direction, an upper frame for supporting a screw shaft to move the plunger support in the vertical direction, and a support frame for supporting a storage container constituting the liquid material storage section 1.

The liquid material storage section 1 is a container made up of a cylindrical main body opened upward and a bowl-like bottom portion. A port for connection to the liquid feed passageway is opened in the bottom portion, and the liquid feed passageway 2 is connected to the port in coaxial relation to the container. Accordingly, the storage container surrounds the liquid feed passageway 2 such that a part of the plunger section 4 is always immersed in the liquid material stored in the container of the storage section 1 during the operation.

The liquid feed passageway 2 has a cylindrical shape with a nozzle fitted to its lower end. The nozzle and the plunger having the seal portion closely contacting the inner peripheral surface of the liquid feed passageway 2 cooperatively constitute a pump.

Further, the liquid material storage section 1 and the liquid feed passageway 2 are connected to each other through the liquid feed valve 7 disposed between them, and the liquid material in the liquid material storage section 1 is supplied to the liquid feed passageway 2 through the liquid feed valve 7. The liquid material supplied to the liquid feed passageway 2 is given with an inertial force from the plunger, which is quickly accelerated to advance and then abruptly stopped, so that the liquid material is delivered in the form of droplets through the nozzle.

Figure 2:
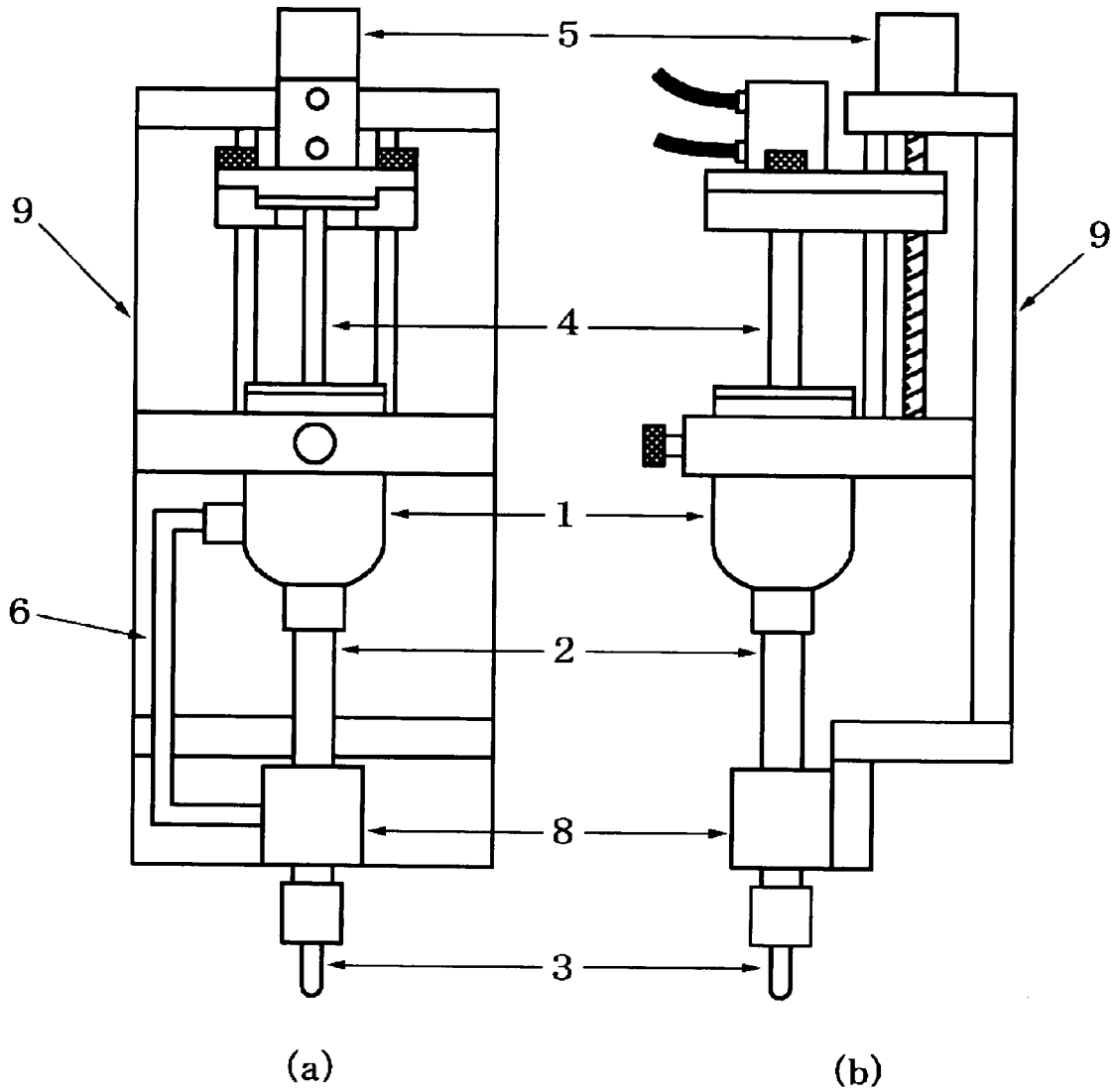

FIG. 2 shows another embodiment of the present invention. A liquid material delivering device of this embodiment comprises a liquid material storage section 1 for storing a liquid material, a nozzle section 3 for delivering the liquid material, a liquid feed passageway 2 for establishing communication between the storage section and the nozzle section 3, a plunger section 4 having a seal portion sliding while closely contacting an inner surface of the liquid feed passageway 2, a plunger moving means 5 for advancing and retracting the plunger section 4, a delivery valve 8 disposed at a nozzle-side distal end of the liquid feed passageway 2 or midway the liquid feed passageway 2, a liquid feed passageway 6 for establishing communication between the delivery valve 8 and a portion of the liquid feed passageway 2 near the liquid material storage section 1 or the liquid material storage section 1 itself, and a frame 9 for supporting the above-mentioned components. The delivery valve 8 can take a first position at which the liquid feed passageway 2 is communicated with the nozzle, and a second position at which the liquid feed passageway 2 is communicated with the liquid feed passageway 6.

Figure 3:
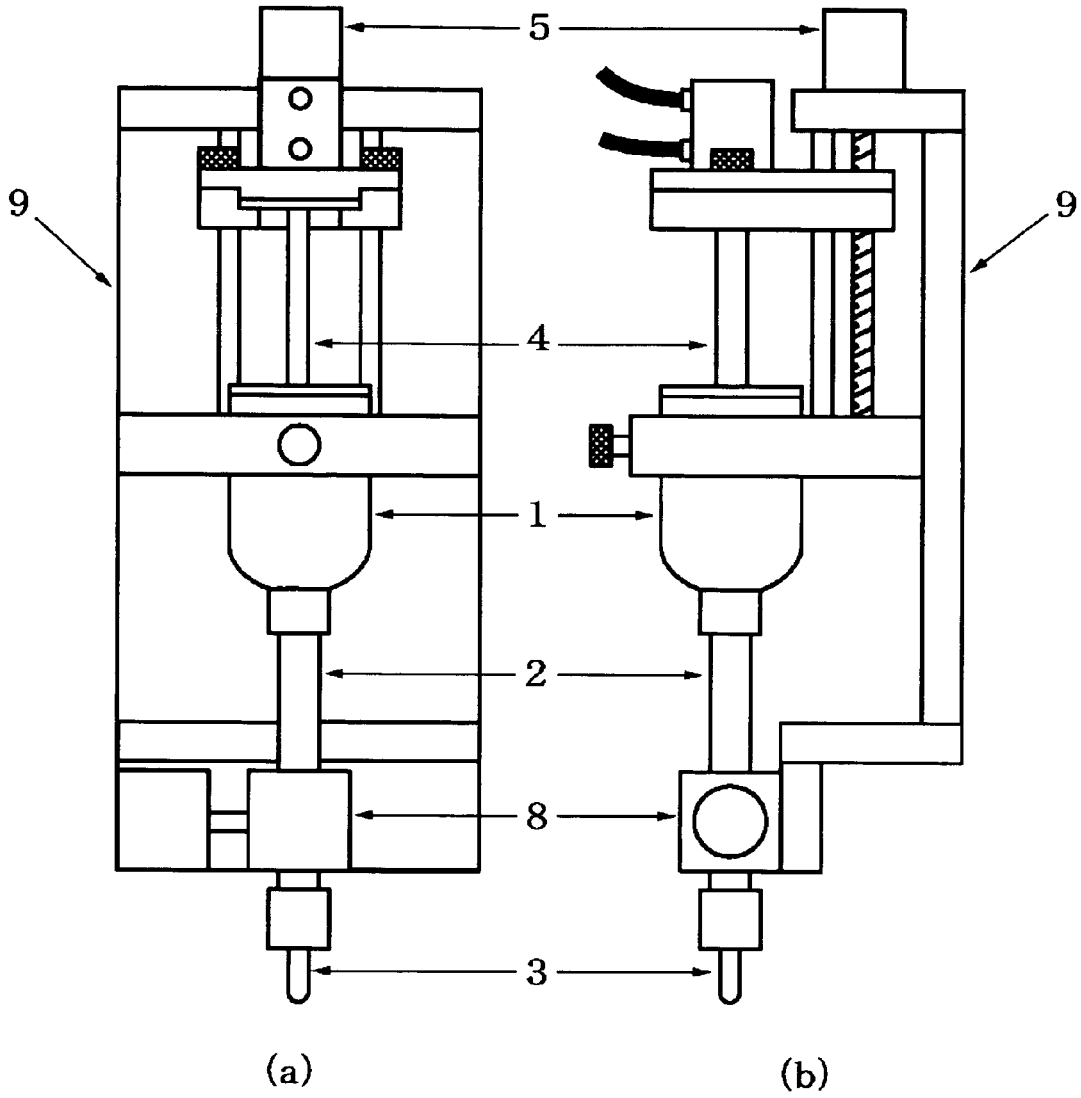

FIG. 3 shows still another embodiment of the present invention. A liquid material delivering device of this embodiment comprises a liquid material storage section 1 for storing a liquid material, a nozzle section 3 for delivering the liquid material, a liquid feed passageway 2 for establishing communication between the storage section and the nozzle section 3, a plunger section 4 having a seal portion sliding while closely contacting an inner surface of the liquid feed passageway 2, a plunger moving means 5 for advancing and retracting the plunger section 4, and a frame 9 for supporting the above-mentioned components. The plunger section 4 includes a valve mechanism for establishing or cutting off communication between the nozzle section 3 and the storage section, and a delivery valve 8 disposed near a nozzle-side distal end of the liquid feed passageway 2 and having a flow passage having the same inner diameter as that of the liquid feed passageway 2.

Figure 4:
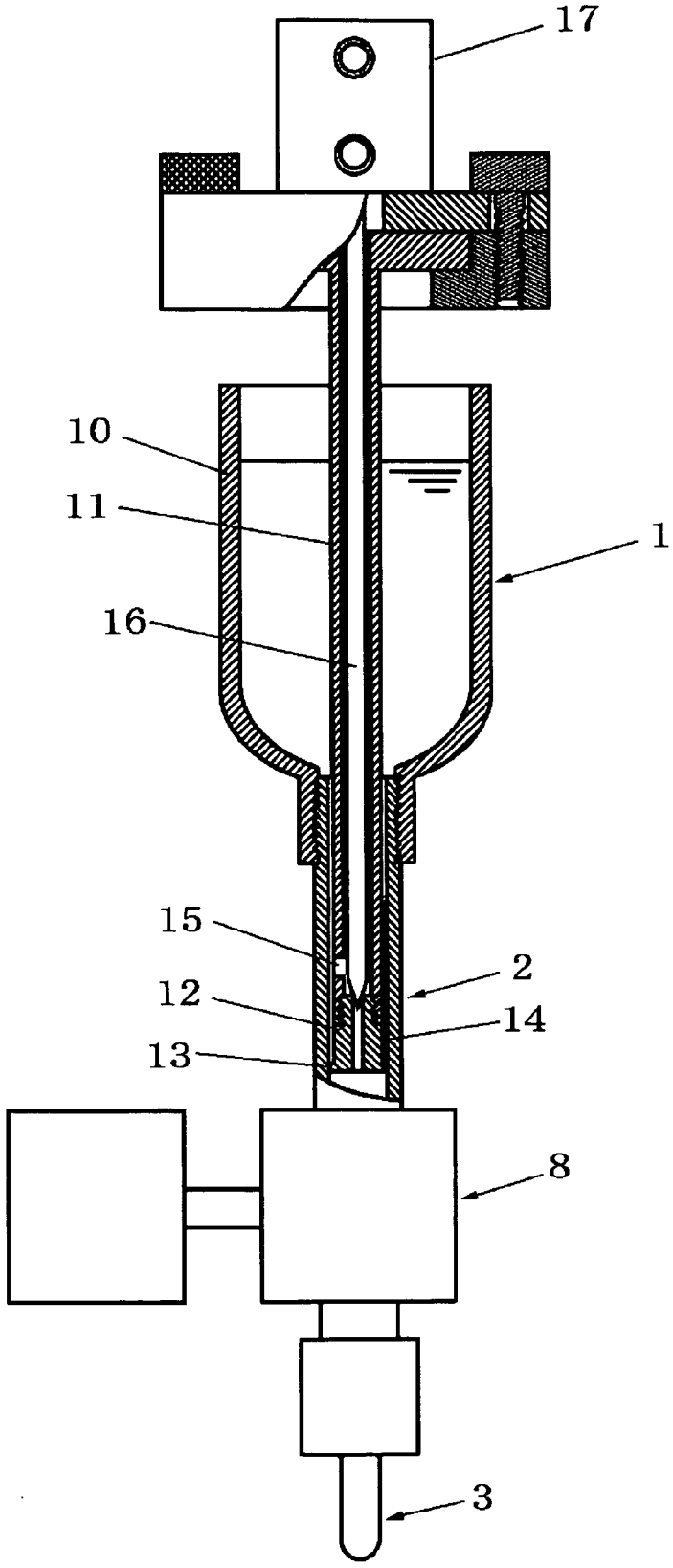
FIG. 4 is a side view of a principal part of the embodiment shown in FIG. 3.

Further, the plunger section 4 in this embodiment includes an air bubble purging mechanism shown in FIG. 4.

More specifically, the plunger section 4 includes an air bubble purging mechanism comprising a plunger rod 11 having a tubular portion formed with an air bubble purging hole 15 opened to an outer wall surface of the plunger rod, a plunger head 12 fitted to a tip of the plunger rod 11, having an air bubble purging hole 14 communicating with the tubular portion of the plunger rod 11, and including a seal portion 13 projecting on an outer wall surface of the plunger head to be closely contacted with the inner wall surface of the liquid feed passageway 2, a valve rod 16 inserted in the tubular portion of the plunger rod 11, and an air cylinder 17 serving as a valve rod driving means for moving the valve rod 16 to open or close the air bubble purging hole 14 of the plunger head 12. When the air cylinder 17 is operated to retract the valve rod 16, the valve rod 16 is moved in the lengthwise direction of the plunger rod 11, thus causing a tip of the valve rod 16 to move away from the plunger head 12. Accordingly, the air bubble purging hole 14 formed in the plunger head 12 is opened and communicated with the exterior via the air bubble purging hole 14 and a gap formed between the plunger rod 11 and the valve rod 16. In this state, the plunger section 4 is advanced to purge air bubbles before the plunger head 12 to the exterior.

The above-described air bubble purging mechanism is also applicable to Embodiments 1 and 2. Also, the valve rod may be moved by using a screw as disclosed in the above-cited prior application.

INDUSTRIAL APPLICABILITY

Thus, according to the present invention, since the sliding surface of the plunger and the inner surface of the liquid feed passageway, along which the plunger slides, are always kept in contact with the liquid material, the sliding surface of the plunger and the inner surface of the liquid feed passageway, along which the plunger slides, are avoided from drying and sticking to each other. It is therefore possible to effectively prevent undesired sliding resistance against the movement of the plunger from increasing due to those phenomena, and to accurately supply the liquid material by delivery, dripping, or ejection in the form of flying droplets.

Also, since the delivering device can be arranged such that the liquid feed passageway subjected to pressurization is not always required to have a branched pipe for feeding the liquid material, a necessary smallest amount of the liquid material can be efficiently pressurized. It is therefore possible to accurately supply the liquid material by delivery, dripping, or ejection in the form of flying droplets.

With the operation of purging out air bubbles trapped in the liquid material, the liquid material discharged in a mixed state together with a group of air bubbles can be reused while effectively purging out the air bubbles. It is therefore possible to effectively utilize the liquid material, which is discharged during the air bubble purging operation, again for delivery, dripping, or ejection in the form of flying droplets without wasting the liquid material.

The invention claimed is:

1. A liquid material delivering method, comprising:

providing a liquid material delivering device comprising:

a liquid material storage section, a nozzle, a first liquid feed passageway for communication between said liquid material storage section and said nozzle, a plunger having a seal portion sliding while closely contacting an inner wall surface of said first liquid feed passageway, wherein said seal portion has a sliding surface to divide a liquid material in said first liquid feed passageway into a nozzle-side liquid material part and a storage section-side liquid material part, a delivery valve for selectively establishing or cutting off communication between said first liquid feed passageway and said nozzle, a second liquid feed passageway for communication between the nozzle-side liquid material part and the storage section-side liquid material part, and a selector valve for selectively establishing or cutting off communication through said second liquid feed passageway;

closing said delivery valve and opening said selector valve of the liquid material delivering device;

supplying the liquid material to the nozzle-side liquid material part of the liquid material delivering device;

opening said delivery valve and closing said selector valve of the liquid material delivering device; and advancing said plunger along the inner wall surface of said first liquid feed passageway to pressurize the liquid material in the nozzle-side liquid material part, thereby delivering the liquid material through said nozzle.

2. A liquid material delivering method according to claim 1, wherein said a first end of said second liquid feed passageway for communication between the nozzle-side liquid material part and the storage section-side liquid material part is connected to a portion of said first liquid feed passageway near a nozzle-side distal end thereof, a second end of said second liquid feed passageway is connected to a portion of said first liquid feed passageway new said liquid material storage section or to said storage section itself, and said selector valve is constituted by a liquid feed valve for selectively establishing or cutting off communication through said second liquid feed passageway.

3. A liquid material delivering method according to claim 1, wherein a first end of said second liquid feed passageway is connected to said delivery valve, and a second end of said second liquid feed passageway is connected to said storage section, and said selector valve is constituted by said delivery valve which is constituted to have a first position at which the nozzle section-side liquid material part is communicated with said nozzle and said second liquid feed passageway is cut off from the nozzle section-side liquid material part, and a second position at which the nozzle section-side liquid material part is cut off from the nozzle and said second liquid feed passageway is communicated with the nozzle section-side liquid material part.

4. A liquid material delivering method according to claim 1, wherein said plunger includes a valve mechanism constituting said second liquid feed passageway for communication between the nozzle-side liquid material part and the storage section-side liquid material part, and said selector valve is constituted by the valve mechanism of said plunger.

5. A liquid material delivering method according to claim 4, wherein said valve mechanism comprises a plunger rod having a tubular portion which has a first hole formed in communication with an outer wall surface thereof, a plunger head fitted to a distal end of said plunger rod, having a second hole formed in communication with the tubular portion of said plunger rod, and provided at an outer wall thereof with the seal portion closely contacting the inner wall surface of said first liquid feed passageway, a valve rod inserted in the tubular portion of said plunger rod, and valve rod driving means for driving said valve rod to come into close contact with or to move away from said plunger head, and said second liquid feed passageway for communication between the nozzle-side liquid material part and the storage section-side liquid material part is formed by communicating said first hole and said second hole with each other.

6. A liquid material delivering method according to claim 2 or 3, wherein the delivering method includes a first step of closing said delivery valve and opening said selector valve, a second step of retracting said plunger to feed the liquid material into the nozzle section-side liquid material part from said liquid material storage section, a third step of closing said selector valve and opening said delivery valve, and a fourth step of advancing said plunger to deliver the liquid material.

7. A liquid material delivering method according to claim 4 or 5, wherein delivering method includes a first step of closing said delivery valve and opening said selector valve, a second step of retracting said plunger to feed the liquid material into the nozzle section-side liquid part from said liquid material storage section, a third step of closing said selector valve and opening said delivery valve, and a fourth step of advancing said plunger to deliver the liquid material.

8. A liquid material delivering method according to claim 4 or 5, wherein the delivering method includes, a first step of closing said delivery valve and opening said selector valve, a second step of retracting said plunger to feed the liquid material into the nozzle-side liquid material part from said liquid material storage section, a third step of advancing said plunger in a state that said delivery valve is closed and the nozzle-side liquid material part and the storage section-side liquid material part are communicated with each other by said valve mechanism, thereby removing air bubbles in the liquid material present within said first liquid feed passageway, a fourth step of closing said selector valve and opening said delivery valve, and a fifth step of advancing said plunger to deliver the liquid material.

9. A liquid material delivering method according to claim 6, wherein said a delivery port at a nozzle tip is closed by closing means instead of closing said delivery valve.

10. A liquid material delivering method according to claim 2 or 3, wherein said plunger includes a valve mechanism comprising a plunger rod having a tubular portion which has a first hole formed in communication with an outer wall surface thereof, a plunger head fitted to a distal end of said plunger rod, having a second hole formed in communication with the tubular portion of said plunger rod, and provided at an outer wall thereof with the seal portion closely contacting the inner wall surface of said first liquid feed passageway, a valve rod inserted in the tubular portion of said plunger rod, and valve rod driving means for driving said valve rod to come into close contact with or to move away from said plunger head, and air bubbles in the nozzle section-side liquid material part is discharged by an opening operation of said valve mechanism.

11. A liquid material delivering method according to claim 10, wherein the delivering method includes a first step of closing said delivery valve and opening said selector valve, a second step of retracting said plunger to feed the liquid material into the nozzle-side liquid material part from said liquid material storage section, a third step of advancing said plunger in a state that said delivery valve is closed and the nozzle-side liquid material part and the storage section-side liquid material part are communicated with each other by said valve mechanism, thereby removing air bubbles in the liquid material present within said first liquid feed passageway, a fourth step of closing said selector valve and opening said delivery valve, and a fifth step of advancing said plunger to deliver the liquid material.

12. A liquid material delivering device comprising:

a liquid material storage section for storing a liquid material, a nozzle section for delivering the liquid material, a first liquid feed passageway for communication between said liquid material storage section and said nozzle section, a plunger having a seal portion sliding while closely contacting an inner wall surface of the first liquid feed passageway, said seal portion having a sliding surface to divide the liquid material in said first liquid feed passageway into a nozzle section-side liquid material part and a storage section-side liquid material part, said plunger being advanced along the inner wall surface of said first liquid feed passageway to pressurize one part of the divided liquid material, which provides the nozzle section-side liquid material part, thereby delivering the liquid material through said nozzle section, plunger moving means for advancing and retracting said plunger, a delivery valve for selectively establishing or cutting off communication between said first liquid feed passageway and said nozzle section, a second liquid feed passageway for communication between the nozzle section-side liquid material part and the storage section-side liquid material part, and a selector valve for selectively establishing or cutting off communication through said second liquid feed passageway.

13. A liquid material delivering device according to claim 12, wherein a first end of said second liquid feed passageway for communication between the nozzle section-side liquid material part and the storage section-side liquid material part is connected to said delivery valve and a second end of said second liquid feed passageway is connected to a portion of said first liquid feed passageway near the storage section-side distal end thereof or said storage section itself, and said selector valve is constituted by said delivery valve which is constituted to have a first position at which the nozzle section-side liquid material part is communicated with said nozzle section and said second liquid feed passageway is cut off from the nozzle section-side liquid material part, and a second position at which the nozzle section-side liquid material part is cut off from the nozzle section and said second liquid feed passageway is communicated with the nozzle section-side liquid material part.

14. A liquid material delivering device according to claim 12, wherein a first end of said second liquid feed passageway is connected to a portion of said first liquid feed passageway near a nozzle section-side distal end thereof, and a second end of said second liquid feed passageway is connected to a portion of said first liquid feed passageway near said storage section or said storage section itself, and said selector valve is a liquid feed valve disposed at a distal end of said second liquid feed passageway or midway said second liquid feed passageway.

15. A liquid material delivering device according to claim 12, wherein said plunger includes a valve mechanism constituting said second liquid feed passageway for communication between the nozzle-side liquid material part and the storage section-side liquid material part, and said selector valve is constituted by the valve mechanism of said plunger.

16. A liquid material delivering device according to claim 15, wherein said valve mechanism comprises a plunger rod having a tubular portion which has a first hole formed in communication with an outer wall surface thereof, a plunger head fitted to a distal end of said plunger rod, having a second hole formed in communication with the tubular portion of said plunger rod, and provided at an outer wall thereof with the seal portion closely contacting the inner wall surface of said liquid feed passageway, a valve rod inserted in the tubular portion of said plunger rod, and valve rod driving means for driving said valve rod to come into close contact with or to move away from said plunger head, and said second liquid feed passageway for communication between the nozzle-side liquid material part and the storage section-side liquid material part is fanned by communicating said first hole and said second hole with each other.

17. A liquid material delivering device according to claim 12, 15 or 16, wherein the inner diameter of said first liquid feed passageway and the inner diameter of said delivery valve are substantially equal to each other.

18. A liquid material delivering device according to claim 16, comprising:

a first step of closing said delivery valve and opening said valve rod inserted in the tubular portion of said plunger rod with respect to said plunger head, a second step of retracting said plunger to feed the liquid material into the nozzle section-side liquid material part from said liquid material storage section, a third step of opening said delivery valve and closing said valve rod, and a fourth step of advancing said plunger.

19. A liquid material delivering device according to claim 13 or 14, wherein said plunger includes a plunger rod having a tubular portion which has a first hole fanned in communication with an outer wall surface thereof, a plunger head fitted to a distal end of said plunger rod, having a second hole formed in communication with the tubular portion of said plunger rod, and provided at an outer wall thereof with the seal portion closely contacting the inner wall surface of said first liquid feed passageway, a valve rod inserted in the tubular portion of said plunger rod, and valve rod driving means for driving said valve rod to come into close contact with or to move away from said plunger head.

20. A liquid material delivering device according to claim 19, comprising:

a first step of closing said delivery valve and opening said valve rod inserted in the tubular portion of said plunger rod with respect to said plunger head, a second step of retracting said plunger to feed the liquid material into the nozzle section-side liquid material part from said liquid material storage section, a third step of opening said delivery valve and closing said valve rod, and a fourth step of advancing said plunger section.

* * * * *